US005397959A

United States Patent [19]

Takahashi et al.

[11] Patent Number: 5,397,959

[45] Date of Patent: Mar. 14, 1995

[54] TWIN-CONVEX ELECTRON GUN

[75] Inventors: Chie Takahashi; Hisakazu Yamane, both of Nagaokakyo, Japan

[73] Assignee: Mitsubishi Denki Kabushiki Kaisha, Tokyo, Japan

[21] Appl. No.: 209,624

[22] Filed: Mar. 14, 1994

[30] Foreign Application Priority Data

Sep. 27, 1993 [JP] Japan ..... 5-240063

[51] Int. Cl.[6] ..... H01J 29/46; H01J 29/56

[52] U.S. Cl. ..... 315/14; 313/414

[58] Field of Search ..... 315/14, 15; 313/414, 313/449

[56] References Cited

U.S. PATENT DOCUMENTS 4,496,877 1/1985 Kueny ..... 315/15

5,223,764 6/1993 Chen ..... 313/414

FOREIGN PATENT DOCUMENTS 1-38345 8/1989 Japan .

OTHER PUBLICATIONS

"Projection Tubes for Professional Use", National Technical Report, vol. 28, No. 1—Feb. 1982, pp. 37–42.

"A New High Resolution Gun for Projection Tube", Suzuki et al.—National Technical Report, vol. 28, No. 1—Feb. 1982, pp. 132–142.

*Primary Examiner*—Theodore M. Blum

[57] ABSTRACT

An electron gun for a cathode-ray tube has, in addition to its main lens, a triode with first and second grids as control electrodes. The thickness of the second grid, and the separation between the first and second grids, is at most one-half the diameter of the beam aperture in the second grid. These dimensions lead to formation of a prefocus lens with no concave lens component, hence with no beam diverging effect. The resulting triode aberration corrects spherical aberration in the main lens, so that the size of the beam spot focused on the screen has little tendency to increase with increasing beam current.

6 Claims, 9 Drawing Sheets $D_{G1} = D_{G2}$
t : THICKNESS
D : DIAMETER

TWIN-CONVEX ELECTRON GUN

BACKGROUND OF THE INVENTION

The present invention relates to an electron gun for a cathode-ray tube.

FIG. 1 shows the electrode configuration of a quadripotential-focus (QPF) electron gun of the cathode-drive type, which is one example of the prior art. FIG. 2 illustrates the principle of this QPF electron gun.

Referring to FIG. 1, the QPF electron gun comprises a stem 1, three cathodes 2, and a first grid 3, second grid 4, third grid 5, fourth grid 6, fifth grid 7, and sixth grid 8. The first and second grids 3 and 4 are control electrodes comprising flat plates with apertures for passage of the three electron beams emitted from the cathodes 2. The fourth grid 6 comprises a generally similar electrode. The third, fifth, and sixth grids 5, 7, and 8 comprise cylindrical electrodes with interior or end baffles having apertures for passage of the electron beams.

A fixed anode voltage $E_B$ is applied to the sixth grid 8. A focus voltage $E_F$ generally equal to 20% to 30% of the anode voltage is applied to the third and fifth grids 5 and 7. The fifth and sixth grids 7 and 8 form a main lens 12, as indicated in FIG. 2. A lower fixed voltage $E_{G2}$ is applied to the second grid 4. The same voltage $E_{G2}$ or another voltage lower than the focus voltage is applied to the fourth grid 6, forming the prefocus lens 11 indicated in FIG. 2. A still lower fixed voltage $E_{G1}$ is applied to the First grid 3. Red, green, and blue video signal voltages, generally intermediate between $E_{G1}$ and $E_{G2}$, are applied to the cathodes 2. The part comprising the cathodes 2 and the first, second, and third grids 3, 4, and 5 is referred to as the triode 14.

The operation of the QPF electron gun is illustrated schematically in FIG. 2. An electron beam 101 emitted from one of the cathodes 2 is brought to a crossover 13 by the first and second grids 3 and 4, then prefocused by the unipotential lens effect of the prefocus lens 11. The prefocused electron beam is then focused onto a screen 10 by the bi-potential effect of the main lens 12, forming a beam spot.

FIG. 3 shows the potential distribution in the triode 14 of this QPF electron gun, omitting the third grid 5. It is convenient to discuss the electron optics in FIG. 3 in terms of an equivalent optical lens system, shown in FIG. 4, comprising a convex lens 102, a concave lens 103, and a convex lens 104. The concave lens 103 has a divergent effect that aligns the virtual object points of rays 15 emitted from the periphery of the cathode 2 and rays 16 emitted from near the center of the cathode 2 to substantially the same virtual object point 17. (The virtual object point is the position of the object point as seen from the main lens 12; this position affects the focal length of the main lens 12.) Another effect of the concave lens 103 is to suppress movement of the virtual object point when the beam current is increased. The beam aberration of the triode 14 can thereby be reduced, a beam spot with a small diameter can be formed on the screen 10, and resolution can be improved.

FIG. 5 shows electron trajectories in the conventional QPF electron gun at a low beam current level, while FIG. 6 shows electron trajectories at a high current level. At the low current level, under ideal conditions with no aberration, a beam emitted from a single point would be Focused to a single point. Under actual conditions, at low current levels, spherical aberration in the main lens 12 causes peripheral rays to be brought to a shorter focus, resulting in a slight enlargement of the beam-spot diameter on the screen 10, as shown in FIG. 5. As the beam current increases, so does the spherical aberration of the main lens 12, leading to a great enlargement of the spot size on the screen 10 as shown in FIG. 6. The result of this so-called blooming effect is poor resolution on the screen.

One conventional solution to this problem has been to increase the thickness of the second grid 4, in order to reduce the aberration of the main lens 12. Other conventional solutions have been to reduce the diameters of the beam apertures in the third, fourth, and fifth grids 5, 6, and 7 or to increase the thickness of the fourth grid 6, in order to strengthen the prefocus lens 11, thereby reducing the beam diameter at the position of its center of deflection. These solutions do not lead to fundamental improvements, however, because they enlarge the diameter of the virtual object point 17, resulting in increased magnification, so that the beam-spot diameter is increased in the center of the screen 10.

SUMMARY OF THE INVENTION

It is accordingly an object of the present invention to reduce the amount by which increased beam current increases the spot size on the screen, thereby obtaining good resolution at high current levels.

Another object of the invention is to reduce the variation in beam-spot size due to the current level.

The invented electron gun is for use in a cathode-ray tube, and comprises a triode and a main lens. The triode has a cathode that emits an electron beam, and first and second electrodes with apertures through which the electron beam passes. The main lens focuses the electron beam onto a screen. The separation between the first and second electrodes and the thickness of the second electrode are adapted to form a convex lens which does not cause the electron beam to diverge.

More specifically, the thickness of the second electrode, and the separation between the first and second electrodes, are at most one-half the diameter of the aperture in the second electrode for passage of the electron beam. The separation between the first and second electrodes is also at most one-half the diameter of the aperture in the first electrode for passage of the electron beam.

The potential difference between the cathode and the second electrode is at most four hundred volts in the cutoff state. Reducing this potential difference to at most four hundred volts reduces the angle of divergence of the electron gun.

DETAILED DESCRIPTION OF THE INVENTION

Embodiments of the invention for use in a color cathode-ray tube will be described with reference to the attached illustrative drawings. These drawings do not restrict the scope of the invention, which should be determined solely from the appended claims.

Figure 7:
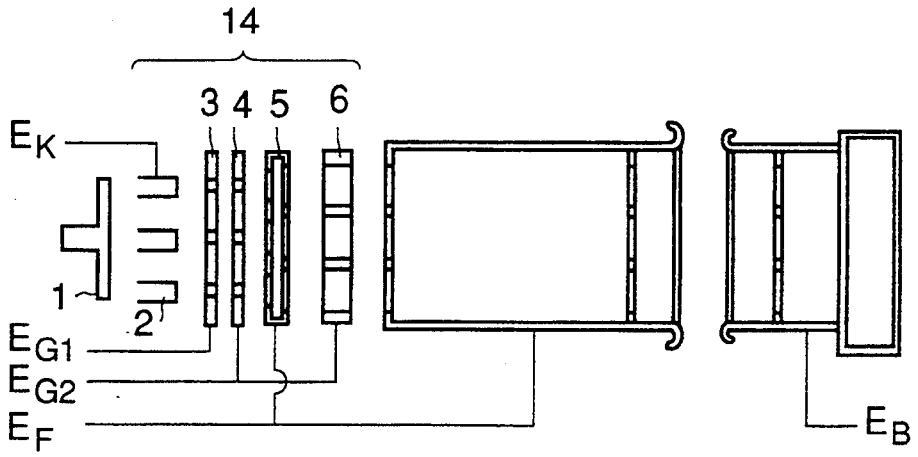
FIG. 7 illustrates the electrode configuration of an electron gun of the present invention.
Figure 8:
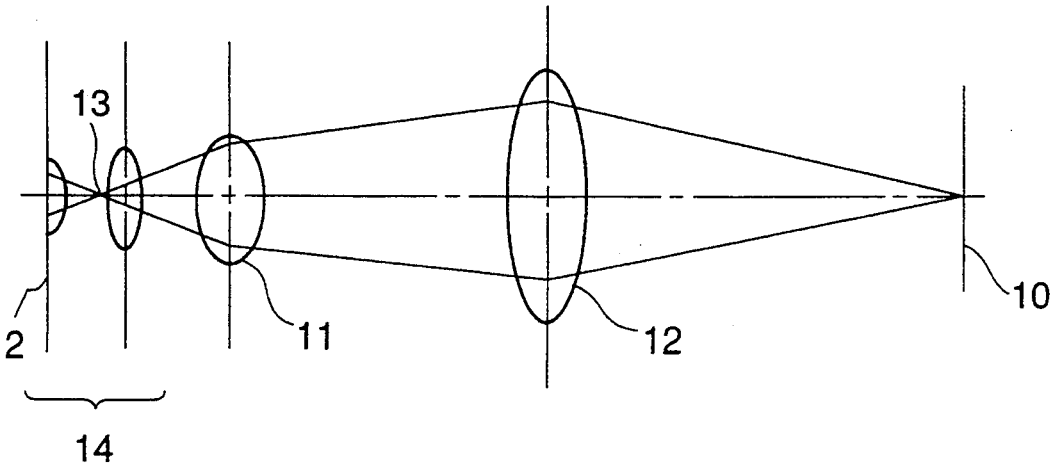
FIG. 8 illustrates the principle of the electron gun of the present invention.
Figure 9:
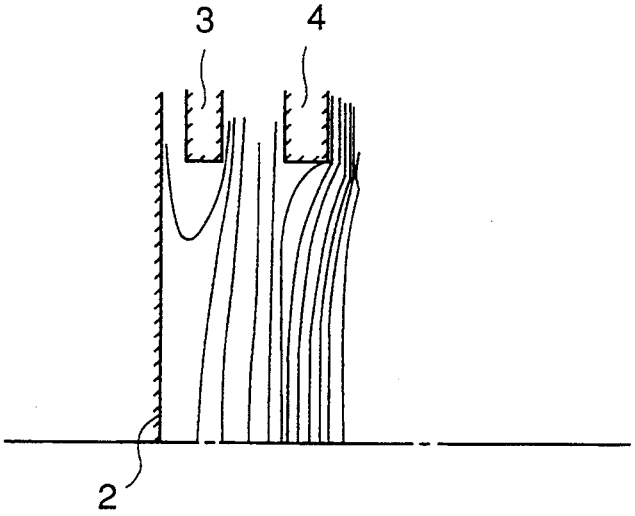
FIG. 9 illustrates the potential distribution in the triode of the electron gun of the present invention.
Figure 10:
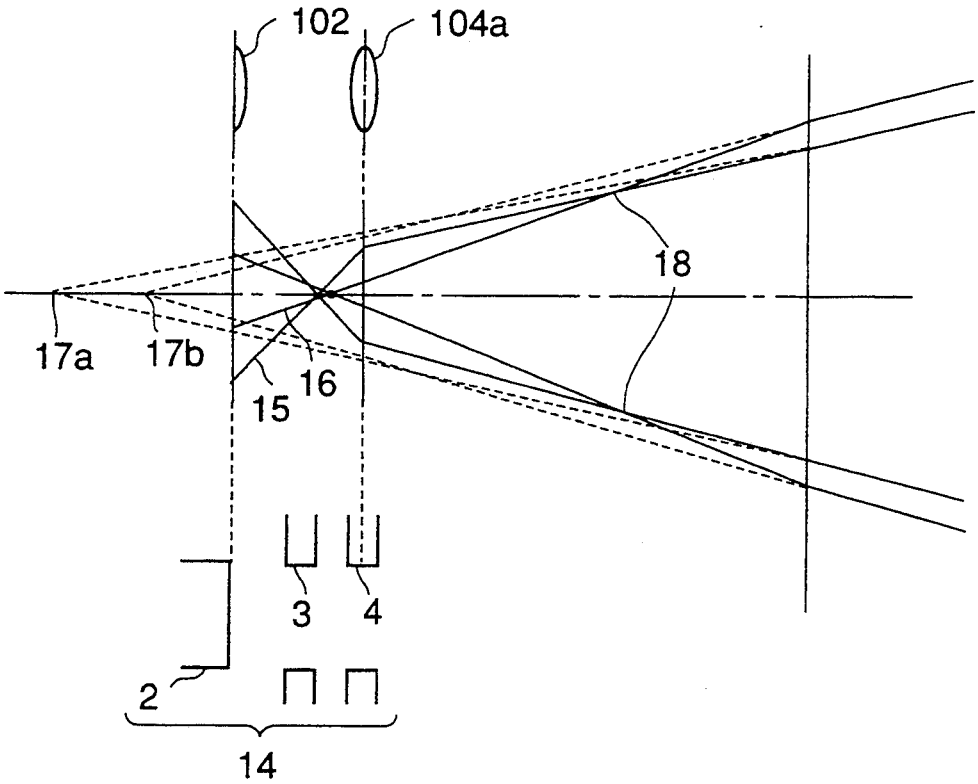
FIG. 10 describes the electron gun of the present invention in terms of an equivalent optical lens system.

FIG. 7 shows the electrode configuration of an electron gun embodying the present invention, for use in a cathode-ray tube. FIG. 8 shows the configuration of lenses formed by the electrodes in FIG. 7. FIG. 9 illustrates the potential distribution in the triode 14 of FIGS. 7 and 8. FIG. 10 shows an equivalent optical lens system. These figures correspond to FIGS. 1 to 4, and use the same reference numerals.

As shown in FIG. 8, the triode 14 of the invented electron gun forms two convex lenses, a configuration which will be referred to as convex-convex or twin-vex.

Referring once again to FIG. 4, because of the divergent effect of the concave lens 103 in the triode 14 of the conventional QPF electron gun, the virtual object point 17, as seen from the prefocus lens 11, was in substantially the same position for both peripheral rays 15 and inner rays 16. Accordingly, as seen from the prefocus lens 11, the peripheral rays 15 and inner rays 16 did not cross, and the aberration of the triode 14 could be reduced.

In the present invention, as shown in FIG. 10, no concave lens is formed in the triode 14, so peripheral rays 15 and inner rays 16 emitted from the cathode 2 have different virtual object points. The virtual object point 17*a* of a peripheral ray 15 is disposed farther from the main lens 12 than the virtual object point 17*b* of an inner ray 16. The difference between the virtual object points 17*a* and 17*b* of peripheral and inner rays becomes particularly pronounced at high beam current levels, when the active area of the cathode 2 is comparatively large. The result is that the peripheral rays 15 and inner rays 16 cross at points 18 in FIG. 10, and the aberration of the triode 14 becomes large. This effect will be referred to below as the twin-vex effect.

Figure 11:
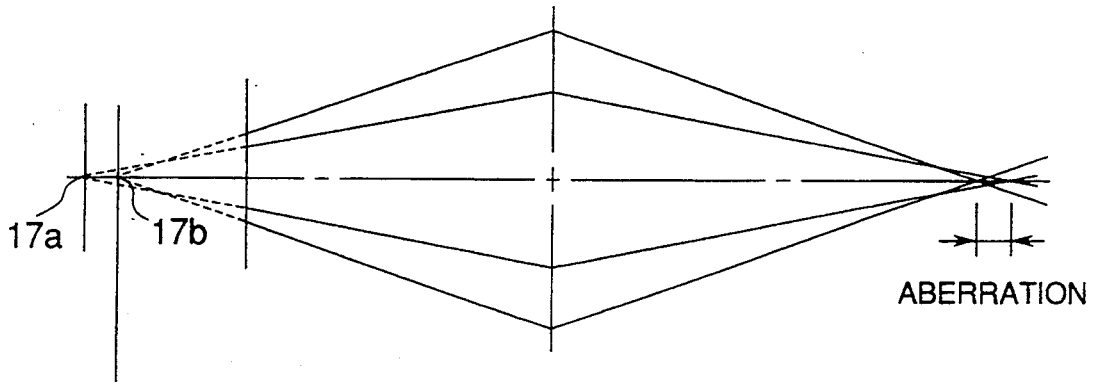
FIG. 11 shows electron trajectories in the electron gun of the present invention at a low beam current level.
Figure 12:
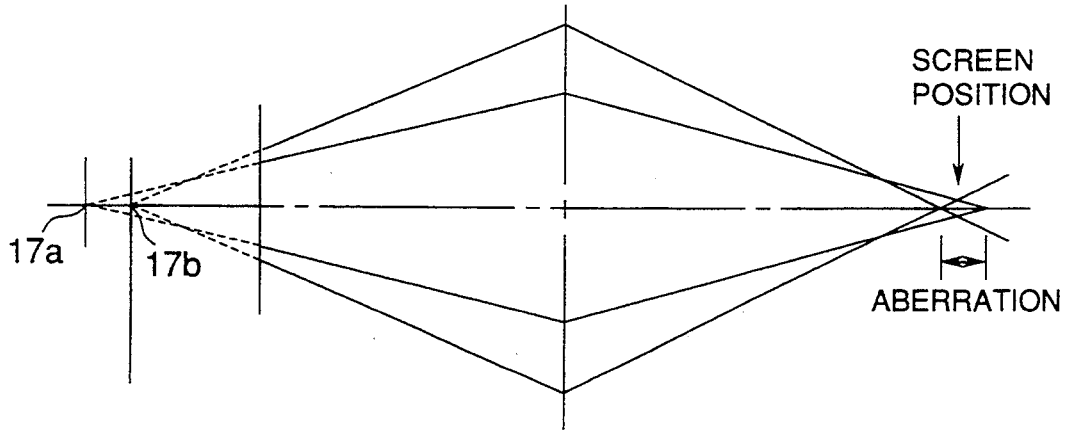
FIG. 12 shows electron trajectories in the electron gun of the present invention at a high beam current level.

The lens aberration arising from the twin-vex effect in the triode 14 can be used to reduce the spherical aberration of the main lens 12, particularly at medium and high current levels. The principle is illustrated ill FIGS. 11 and 12. FIG. 11 shows electron trajectories at a low current level in the present invention. FIG. 12 shows electron trajectories at a high current level.

Figure 1:
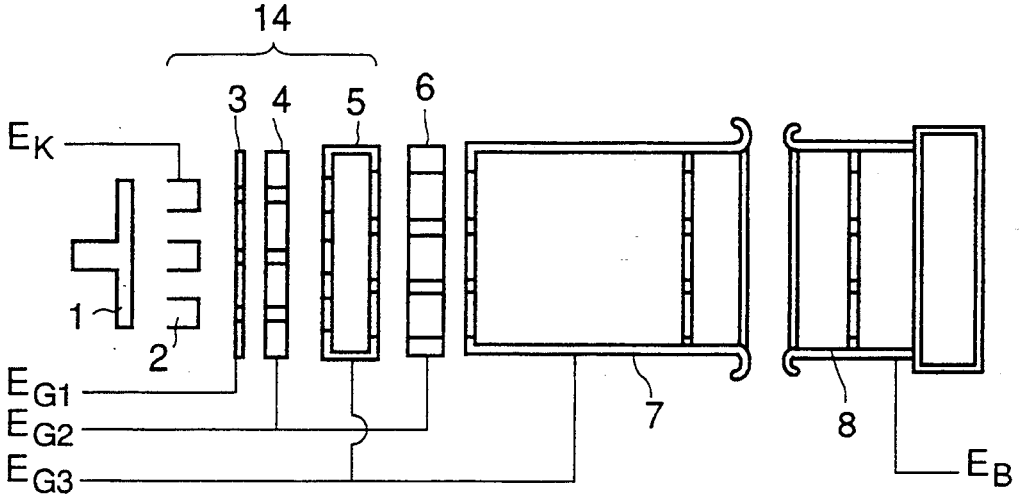
FIG. 1 PRIOR ART
FIG. 1 illustrates the electrode configuration of a conventional electron gun.
Figure 2:
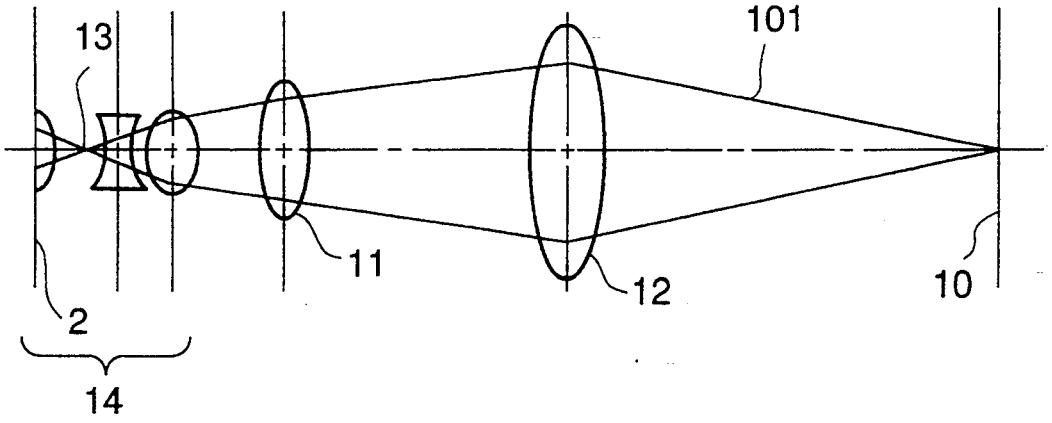
FIG. 2 PRIOR ART
FIG. 2 illustrates the principle of the conventional electron gun.
Figure 3:
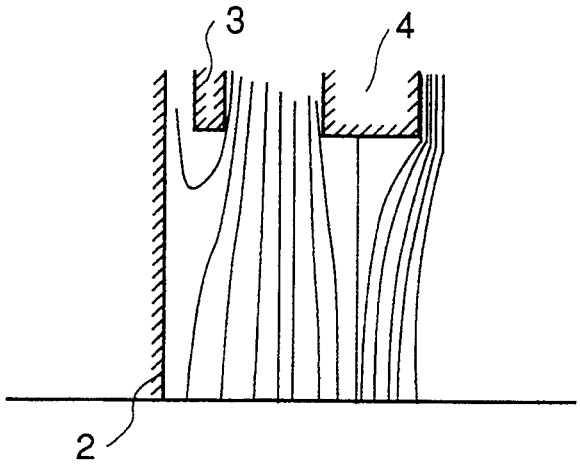
FIG. 3 PRIOR ART
FIG. 3 illustrates the potential distribution in the triode of the conventional electron gun.
Figure 4:
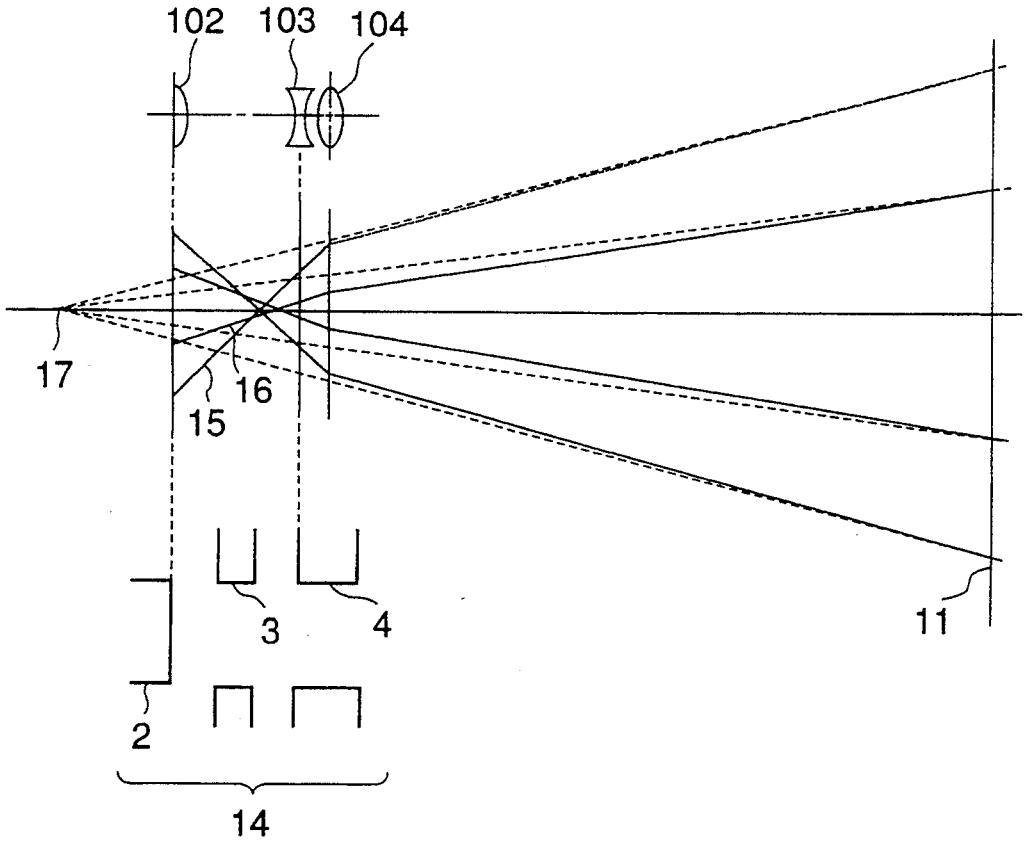
FIG. 4 PRIOR ART
FIG. 4 describes the conventional electron gun in terms of an equivalent optical lens system.
Figure 5:
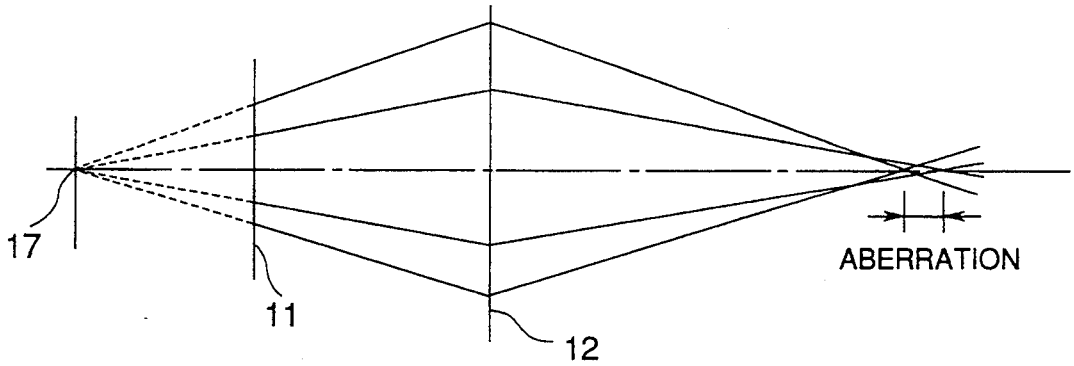
FIG. 5 PRIOR ART
FIG. 5 shows electron trajectories in the conventional electron gun at a low beam current level.
Figure 6:
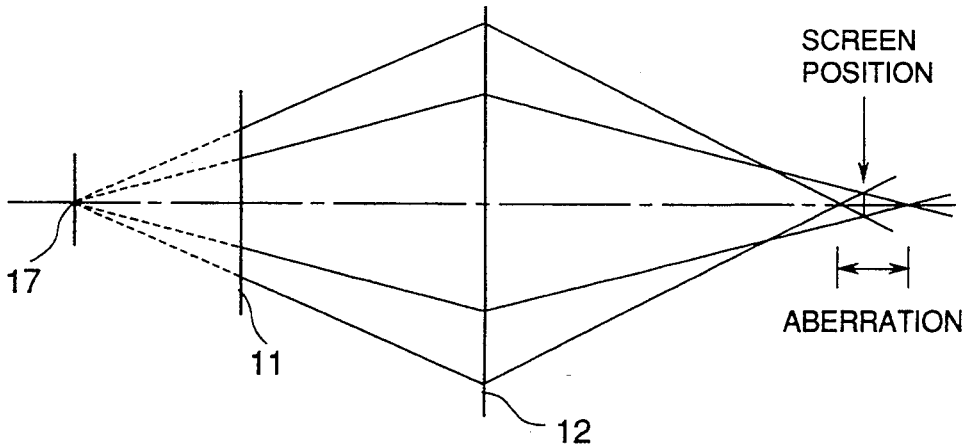
FIG. 6 PRIOR ART
FIG. 6 shows electron trajectories in the conventional electron gun at a high beam current level.

Referring to FIG. 11, at low current levels, the difference in position between the virtual object point 17*a* of peripheral rays and the virtual object point 17*b* of inner rays operates so as to correct the spherical aberration of the main lens 12. The spherical aberration is actually over-corrected, causing the beam diameter to increase, but the amount of increase does not exceed that in the conventional QPF electron gun at comparable current levels, as shown in FIG. 5.

Referring to FIG. 12, at high current levels, where spherical aberration in the conventional QPF electron gun led to a greatly enlarged spot size, the difference in position between the virtual object points 17*a* and 17*b* corrects the spherical aberration of the main lens 12 so that the spot size is only moderately enlarged.

These effects are summarized in Table 1. The lens aberration (difference in position between the virtual object points of peripheral and inner rays) of the triode 14 can be used to reduce the spherical aberration of the main lens 12, particularly at medium and high current levels.

TABLE 1

| | | Triode aberration (twin-vex effect) | Spherical aberration in main lens | Spot size |
|---|---|---|---|---|
| Invented electron gun | Low current | Large | Medium | Small |
| | High current | Large | Large | Small |
| Conventional electron gun | Low current | Small | Medium | Small |
| | High current | Small | Large | Large |

In the triode 14 of an actual electron gun, to form only convex lenses and avoid forming a concave lens as in the conventional triode, it suffices to reduce the separation between the first grid 3 and second grid 4, and reduce the thickness of the second grid 4.

If the separation between the second grid 4 and third grid 5 is as wide as in the conventional QPF electron gun, the convex lens formed at the exit aperture of the second grid 4 is weakened, causing an unwanted increase in the divergence angle. If the prefocus lens 11 is moved closer to the cathode 2, however, the beam diameter in the main lens 12 can be reduced, and degradation of the beam diameter at the periphery of the screen can be prevented.

The beam spot diameter on the screen 10 can thus be Further reduced by narrowing the separation between the second and third grids 4 and 5, and increasing the potential gradient on the beam axis to 10 kV/mm or more, so that the beam is abruptly accelerated, which causes the peripheral part of the beam to bend more sharply inward.

Figure 13:
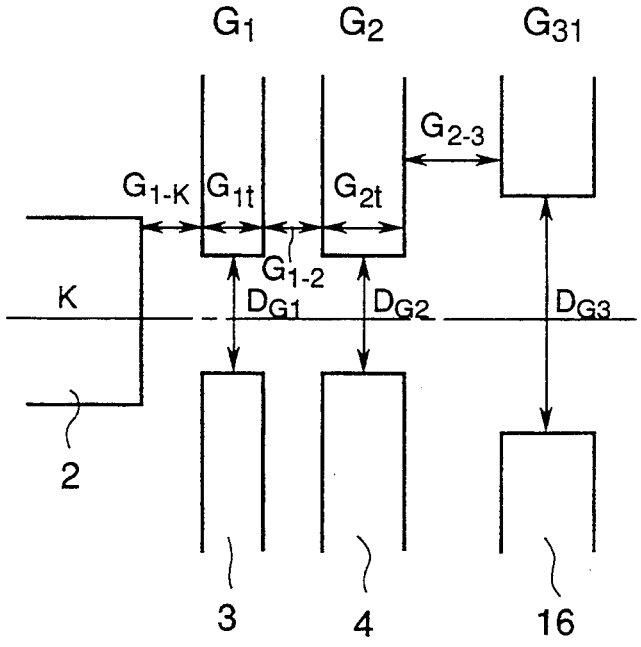
FIG. 13 shows-triode dimensions in the electron gun of the present invention.

Examples of specific dimensions are shown in FIG. 13 and Table 2. According to the invention, the thickness $G_{2t}$ of the second grid 4 is at most one-half the diameter $D_{G2}$ of the beam aperture in the second grid 4. The separation $G_{1\text{-}2}$ between the first and second grids 3 and 4 is also at most one-half $D_{G2}$, and at most one-half the diameter $D_{G1}$ of the beam aperture in the first grid 3. The potential gradient on the beam axis is at least 10 kV/mm. These conditions have a favorable effect on the beam-spot diameter.

TABLE 2

| | Invented electron gun | Conventional gun |
|---|---|---|
| $G_{2t}$ (thickness) | $0.25D_{G2}$ to $0.5D_{G2}$ | $0.6D_{G2}$ to $1.2D_{G2}$ |
| $G_{1-2}$ (separation) | $0.25D_{G2}$ to $0.5D_{G2}$ | $0.6D_{G2}$ to $1.0D_{G2}$ |
| $G_{2-3}$ (potential gradient) | 9 to 12 kV/mm | 4 to 7 kV/mm |

Figure 14:
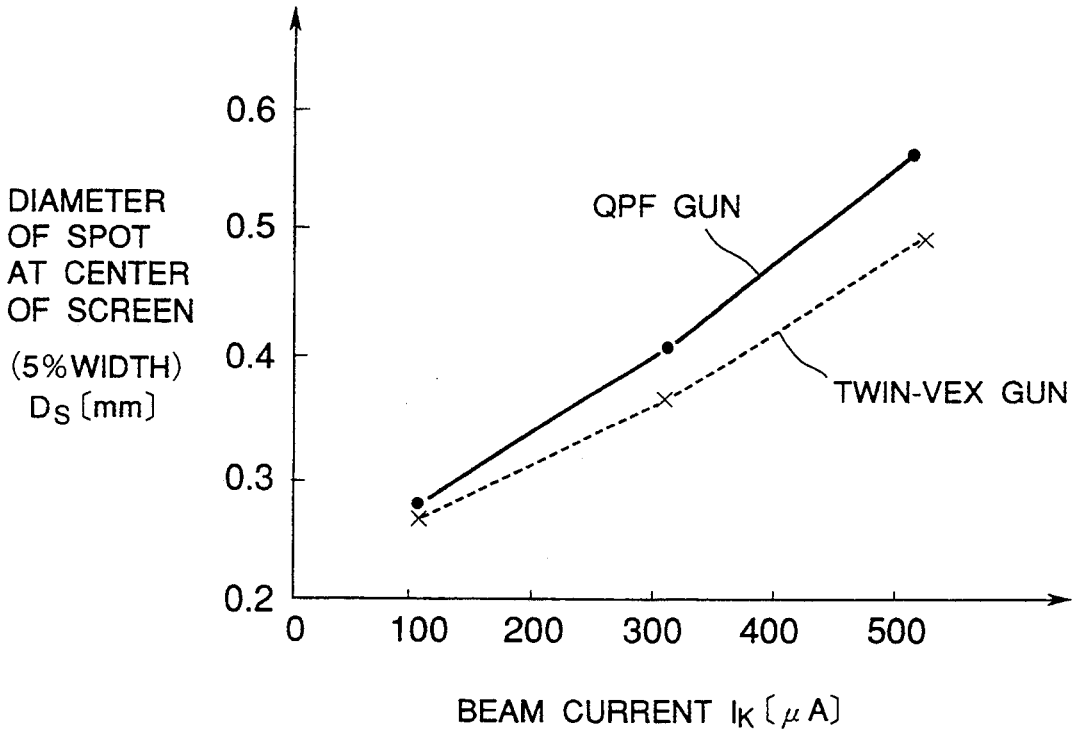
FIG. 14 shows spot diameter as a function of beam current in-the invented and conventional electron guns.

FIG. 14 shows the result of an electron-trajectory analysis done on the basis of the above dimensions. Beam current is shown on the horizontal axis, and the predicted size of the beam spot on the screen is shown on the vertical axis. An improvement of about 10% over the conventional electron gun is predicted at medium and high beam current levels, and an improvement of 5% is predicted at low current levels. The invention is also predicted to produce less variation in the size of the beam spot as the current level varies.

In the electron gun of the present invention as described above, to produce only convex lens effects in the triode 14, it was necessary to make the second grid 4 thinner and reduce the separation between the first grid 3 and second grid 4. When this is done, if the voltage $E_{G2}$ applied to the second grid 4 has the conventional value, then the potential difference between the cathodes 2 and the second grid 4 is substantially seven hundred volts in the cut-off state. The cut-off state is defined as the state in which the beam spot is visually extinguished on the screen. Since the second grid 4 is closer to the first grid 3, to obtain the same beam current as before, the separation between the first grid 3 and cathode 2 must be widened, with consequent adverse effects on the drive characteristic.

The voltage $E_{G2}$ applied to the second grid 4 should therefore be reduced so that the potential difference between the cathodes 2 and the second grid 4 is four hundred volts or less in the cut-off state. This reduction of $E_{G2}$ has the further desirable results of strengthening the convergence effect of the convex lens formed at the exit aperture of the second grid 4, preventing divergence of the electron beam, and enhancing the twin-vex effect.

Figure 15:
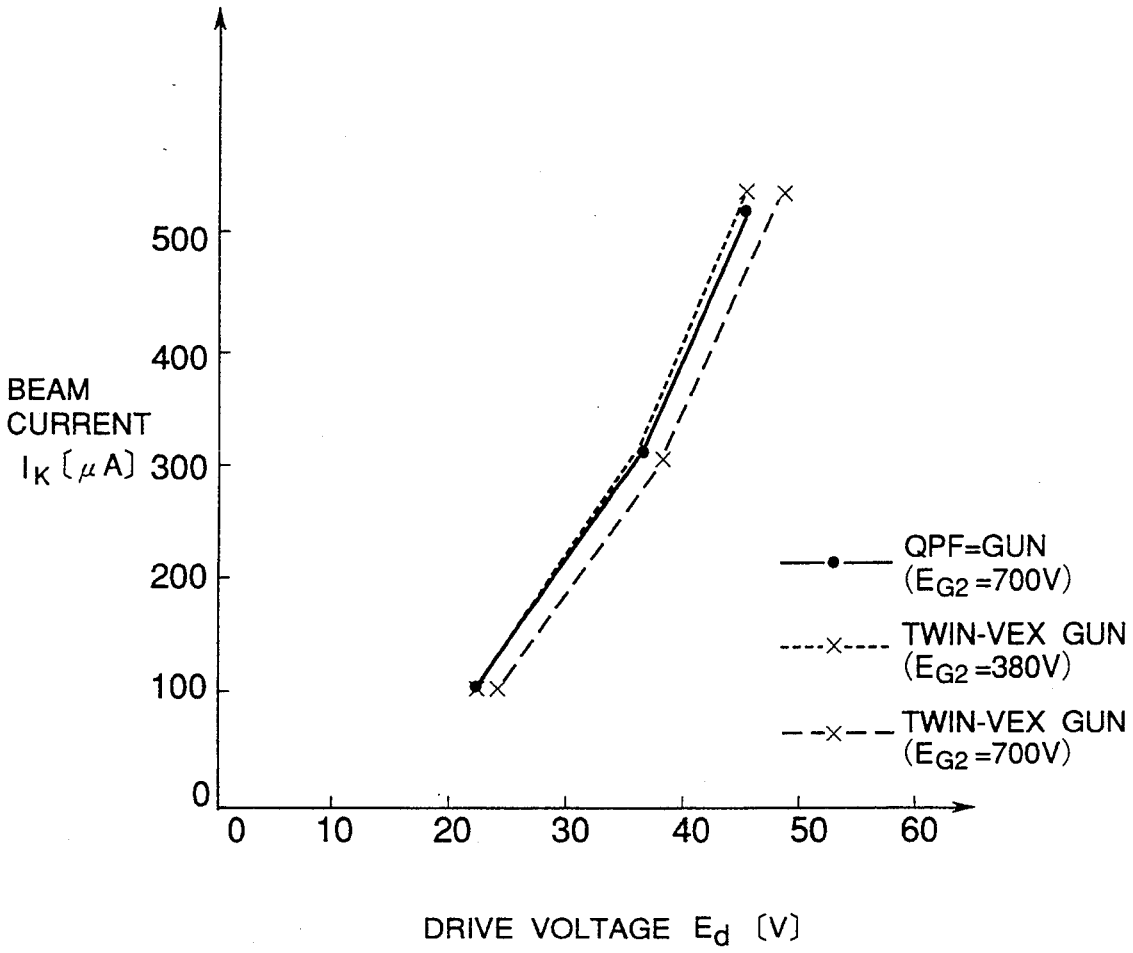
FIG. 15 shows drive characteristics of the invented and conventional electron guns.

FIG. 15 is a drive chart illustrating drive characteristics of the conventional QPF electron gun, the electron gun of the present invention with the second grid 4 biased at 700 V, and the electron gun of the present invention with the second grid 4 biased at 380 V, these bias voltages being relative to the cathode voltage $E_{KO}$ in the cut-off state. Beam current $I_K$ is shown on the vertical axis, and drive voltage $E_d$ on the horizontal axis. The drive voltage $E_d$ is defined as:

$$E_d = E_{KO} - E_K$$

It can be seen that the invention with a 380-V cut-off voltage and the conventional electron gun with a 700-V cutoff voltage have equivalent drive characteristics.

By lessening the increase in spot size that occurs with increasing beam current, the invention can give good resolution at high current levels, and can reduce variation in beam spot size.

Although the drawings have shown an electron gun for a color cathode-ray tube with three beams, the invention can off course also be applied to monochrome cathode-ray tubes with a single electron beam, and those skilled in the art will recognize that further modifications can be made without departing from the scope of the invention as claimed below.

What is claimed is:

1. An electron gun for a cathode-ray tube, comprising:

a triode having a cathode for emitting an electron beam, a first electrode with an aperture having a first diameter for passage of said electron beam, and a second electrode with an aperture having a second diameter for passage of said electron beam and disposed adjacent to said first electrode; and a main lens disposed between said second electrode and a screen for focusing said electron beam onto said screen; wherein said second electrode has a thickness of no more than one-half of said second diameter; and said first electrode and said second electrode are mutually separated by a distance of no more than one-half of said first diameter, and no more than one-half of said second diameter.

2. The electron gun of claim 1, wherein said cathode and said second electrode have a potential difference of less than four hundred volts when said cathode is driven at a cut-off voltage.

3. The electron gun of claim 1, wherein said triode also comprises a third electrode with an aperture for passage of said electron beam, said second electrode is disposed between said first electrode and said third electrode, and an axial potential gradient of at least ten kilovolts per millimeter exists between said second electrode and said third electrode.

4. A method for reducing spot size on screen of cathode ray tube including a triode having a cathode for emitting an electron beam, a second electrode having an aperture of a second diameter for passing said electron beam, and a first electrode disposed between said cathode and said second electrode and having an aperture of a first diameter for passing said electron beam, and a main lens disposed between said second electrode and a screen for focusing said electron beam onto said screen, comprising the steps of:

limiting said thickness of said second electrode to no more than one-half of said second diameter; and separating said first electrode and said second electrode by a distance of no more than one-half of said first diameter, and no more than one-half of said second diameter.

5. The method of claim 4, further comprising the step of:

limiting a potential difference of said cathode and said second electrode to less than four hundred volts when said cathode is driven at a cut-off voltage.

6. The method of claim 4, further comprising the steps of:

passing said electron beam through an aperture of a third electrode disposed adjacent to said second electrode and on the opposite side of said first electrode; and applying an axial potential of at least ten kilovolts per millimeter between said second electrode and said third electrode.

* * * * *